US005377433A

United States Patent [19]

Hazlehurst

[11] Patent Number: 5,377,433

[45] Date of Patent: Jan. 3, 1995

[54] DYNAMIC ARTWORK DISPLAY

[76] Inventor: Laurance N. Hazlehurst, 14921F SE. 177th Pl., Renton, Wash. 98058

[21] Appl. No.: 909,614

[22] Filed: Jul. 7, 1992

[51] Int. Cl.[6] ..... G09F 19/08

[52] U.S. Cl. ..... 40/411; 40/485

[58] Field of Search ..... 40/411, 427, 485, 602; 446/325, 396; D11/141, 160; D21/102; 33/391

[56] References Cited

U.S. PATENT DOCUMENTS

| | | | |
|---|---|---|---|
| D. 220,625 | 5/1971 | Macpherson | D21/102 |
| D. 250,288 | 11/1978 | Horner | D21/102 |
| D. 261,158 | 10/1981 | Matsui | D11/141 |
| 2,874,515 | 2/1959 | Ford | D21/102 |
| 3,022,594 | 2/1962 | Wendell | 40/485 |
| 4,422,530 | 12/1983 | Denton | 40/485 |
| 4,957,258 | 9/1990 | Tiedemann | 40/602 |

FOREIGN PATENT DOCUMENTS

| | | | |
|---|---|---|---|
| 1147267 | 11/1957 | France | 116/63 P |
| 1346357 | 11/1963 | France | 40/602 |

*Primary Examiner*—Brian K. Green

*Attorney, Agent, or Firm*—Delbert J. Barnard; Teresa J. Wiant

[57] ABSTRACT

A dynamic artwork having a pendulum support and a plurality of pendulums positioned side-by-side on the pendulum support wherein each pendulum comprises a plurality of spaced apart end members and an interconnecting central structure which includes a hub. The hubs mount on the pendulum support such that the pendulums have pivotal movement about a horizontal axis. The end members of each pendulum have sufficient mass to provide inertia power for a plurality of swings of each pendulum in response to a starting force applied to the pendulum. Each pendulum swings back and forth about its horizontal axes, within a vertical plane, adjacent each other pendulum until the motion is damped out.

16 Claims, 6 Drawing Sheets

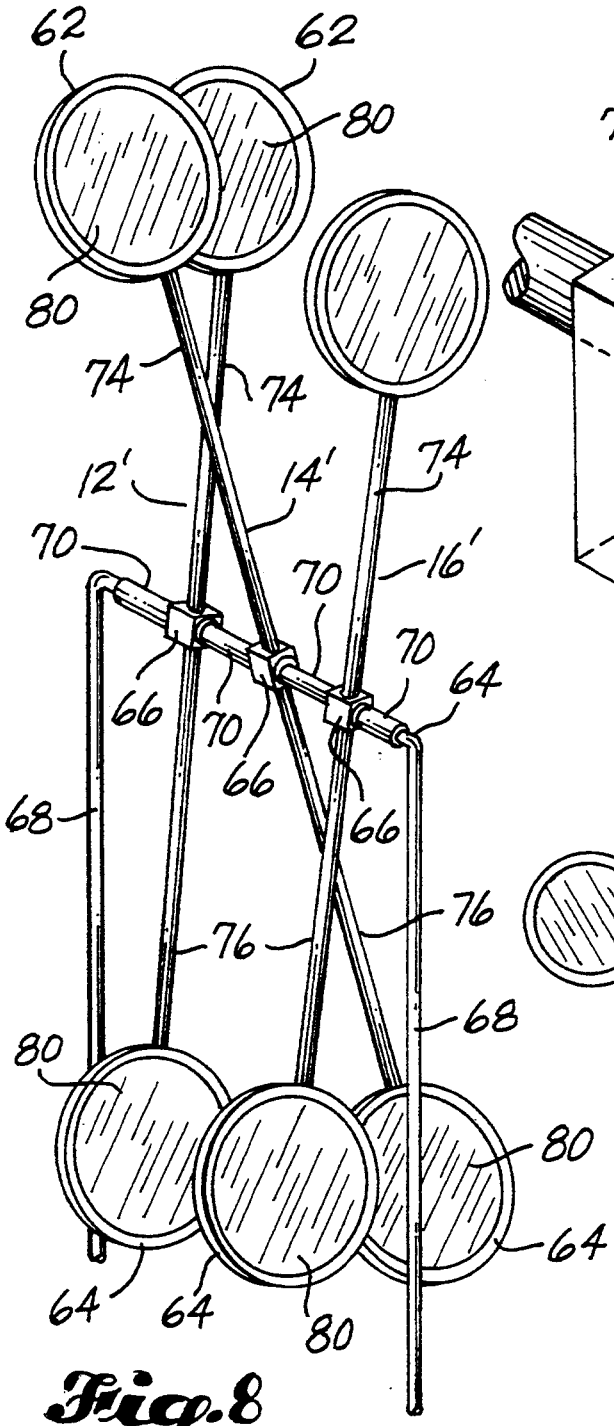
Fig. 8
Fig. 9
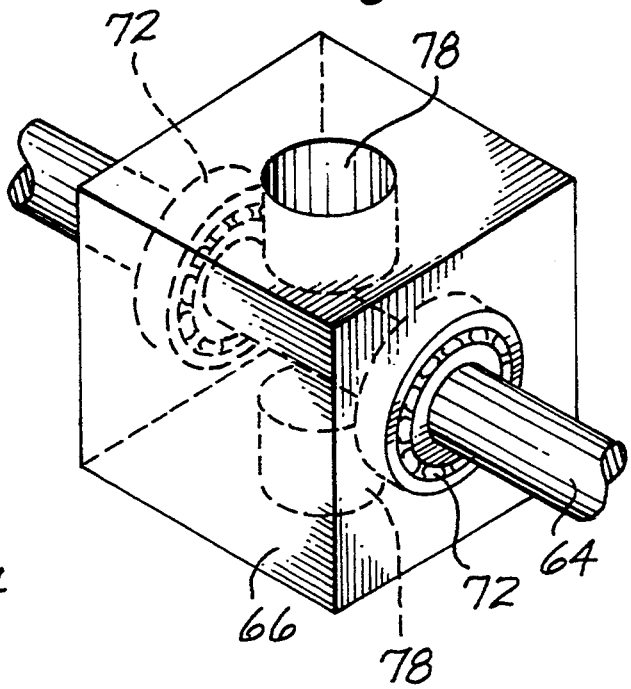
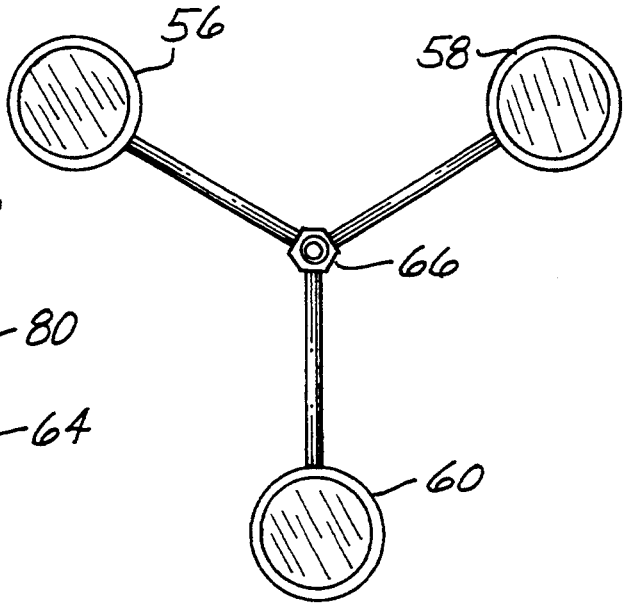
Fig. 7

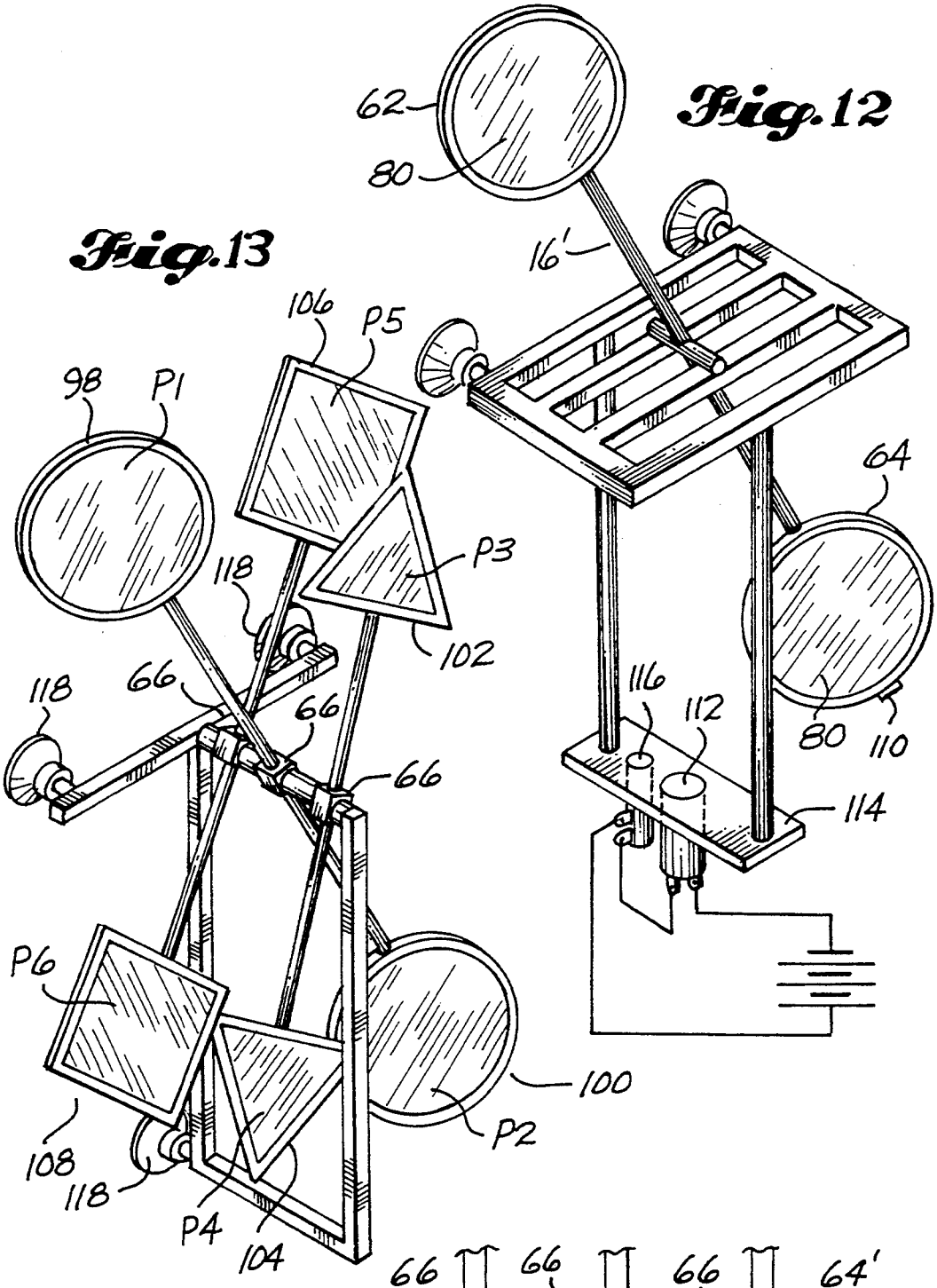
Fig. 12
Fig. 13
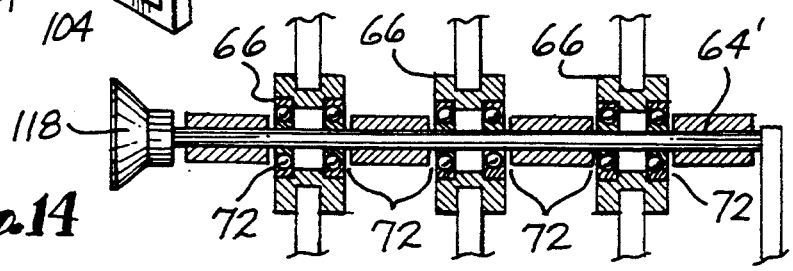
Fig. 14

DYNAMIC ARTWORK DISPLAY

TECHNICAL FIELD

The present invention relates to dynamic artwork, generally, and more particularly to dynamic artwork comprising a plurality of pendulums which move relative to each other.

BACKGROUND INFORMATION

Art is a work produced according to aesthetic principles. Mankind has a high regard for such works and, accordingly, is attracted to such works. It is known that dynamic objects may hold an observer's attention. For example, an observer may find himself staring at a rhythmically moving object, such as a grandfather clock pendulum, a tree branch swaying in the breeze, or a mobile. Watching such objects is both amusing and relaxing to the observer, as may be inferred from the use of mobiles to entertain infants lying in cribs. It is also known that different colors in a dynamic object, such as a pinwheel, holds an observer's attention.

SUMMARY OF THE INVENTION

The present invention provides color and dynamics in a unique piece of artwork. The artwork has a pendulum support and a plurality of pendulums positioned side-by-side on the pendulum support with each pendulum comprising a plurality of spaced apart end members and an interconnecting central structure which includes a hub. The pendulums mount on the pendulum support, with the hub of the pendulum making contact with the pendulum support such that the pendulums have pivotal movement about the hub's horizontal axis. The end members of each pendulum have sufficient mass to provide inertia power for a plurality of swings of the pendulum in response to a starting force applied to the pendulum. Each pendulum swings back and forth about its horizontal axis, within a vertical plane, adjacent each other pendulum in the artwork.

The pendulums are mounted on the pendulum support and the pendulum support is connectable to a stand. The stand may be configured to sit on a horizontal surface, affix to a vertical surface, or be suspended from an elevated surface.

Each pendulum comprises a plurality of end members. The end members may include transparent or translucent portions. Each pendulum comprises at least one end member and an interconnecting central structure which includes a hub. The hub may include trunnions or pivot points such that when the pendulum mounts on the pendulum support, the pendulum has pivotal movement about the hub's horizontal axis with minimal friction.

The artwork of the present invention may be incorporated into an advertising display, used as an educational aid, or used as a novelty object.

Other aspects and features of the present invention will become apparent upon examination of the drawings, claims and description of the best mode for carrying out the invention, all of which constitute a disclosure of the present invention.

BRIEF DESCRIPTION OF THE DRAWINGS

Like reference numerals are used to designate like parts throughout the several drawings.

FIG. 7 is a pictorial view of another embodiment of the pendulums and the pendulum support;

FIG. 8 is a detail view of one embodiment of the hub shown in FIG. 7;

FIG. 9 is a side view of another embodiment of the pendulums;

FIG. 12 is a pictorial view of a further embodiment of the invention, but showing only one of the pendulums, such view showing an upwardly directed electromagnet at the base of the support and an opposing magnet carried by the lower end member of the pendulum;

FIG. 13 is a pictorial view of yet another embodiment of the invention, with the pendulums in such embodiment being adapted for a full 360° swing; and FIG. 14 is a fragmentary view taken at the hub regions of the pendulums shown in FIG. 13, showing the hubs in longitudinal section.

BEST MODE FOR CARRYING OUT THE INVENTION

Figure 1:
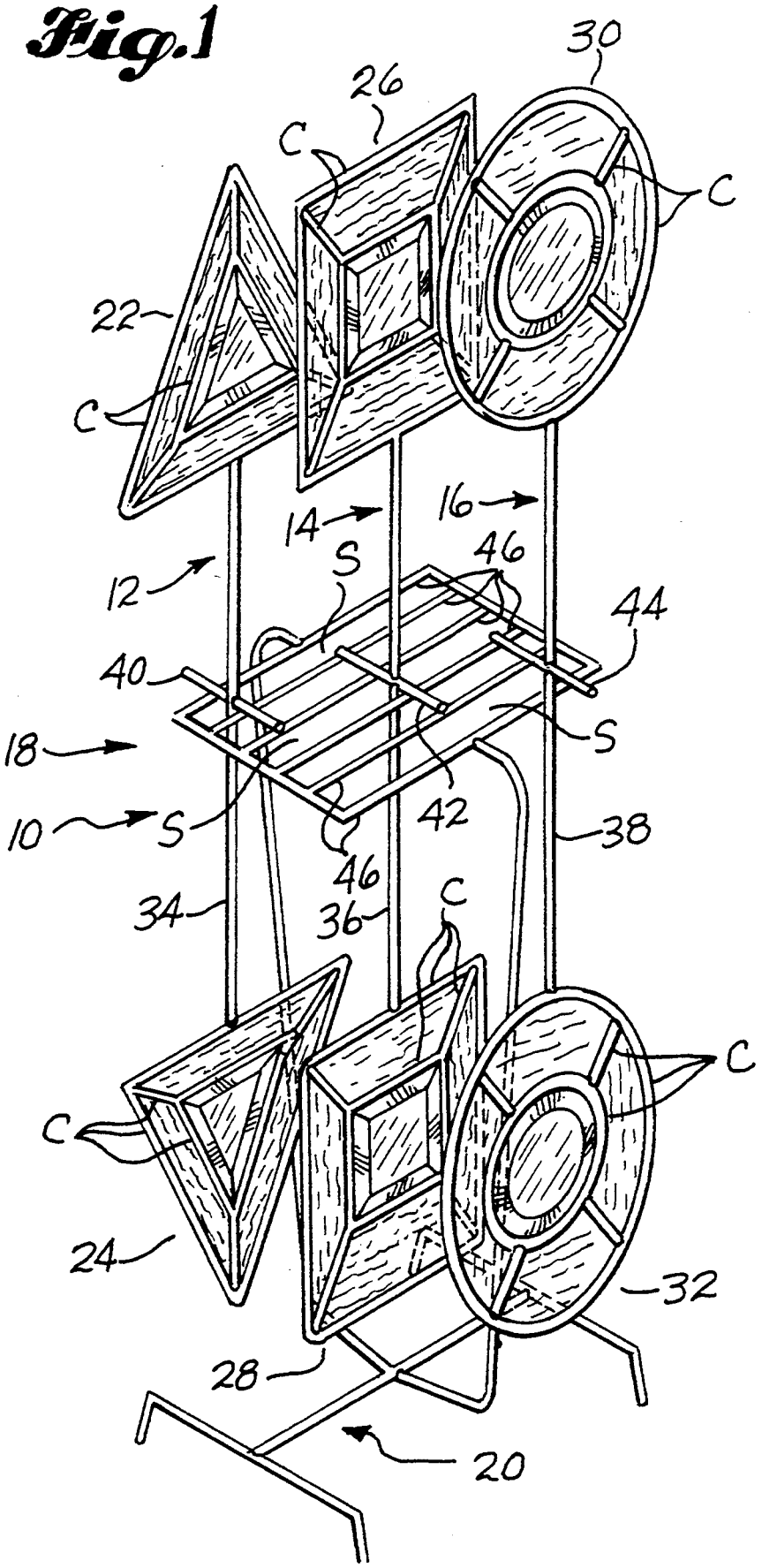
FIG. 1 is a pictorial view of a first embodiment of the present invention.
Figure 2:
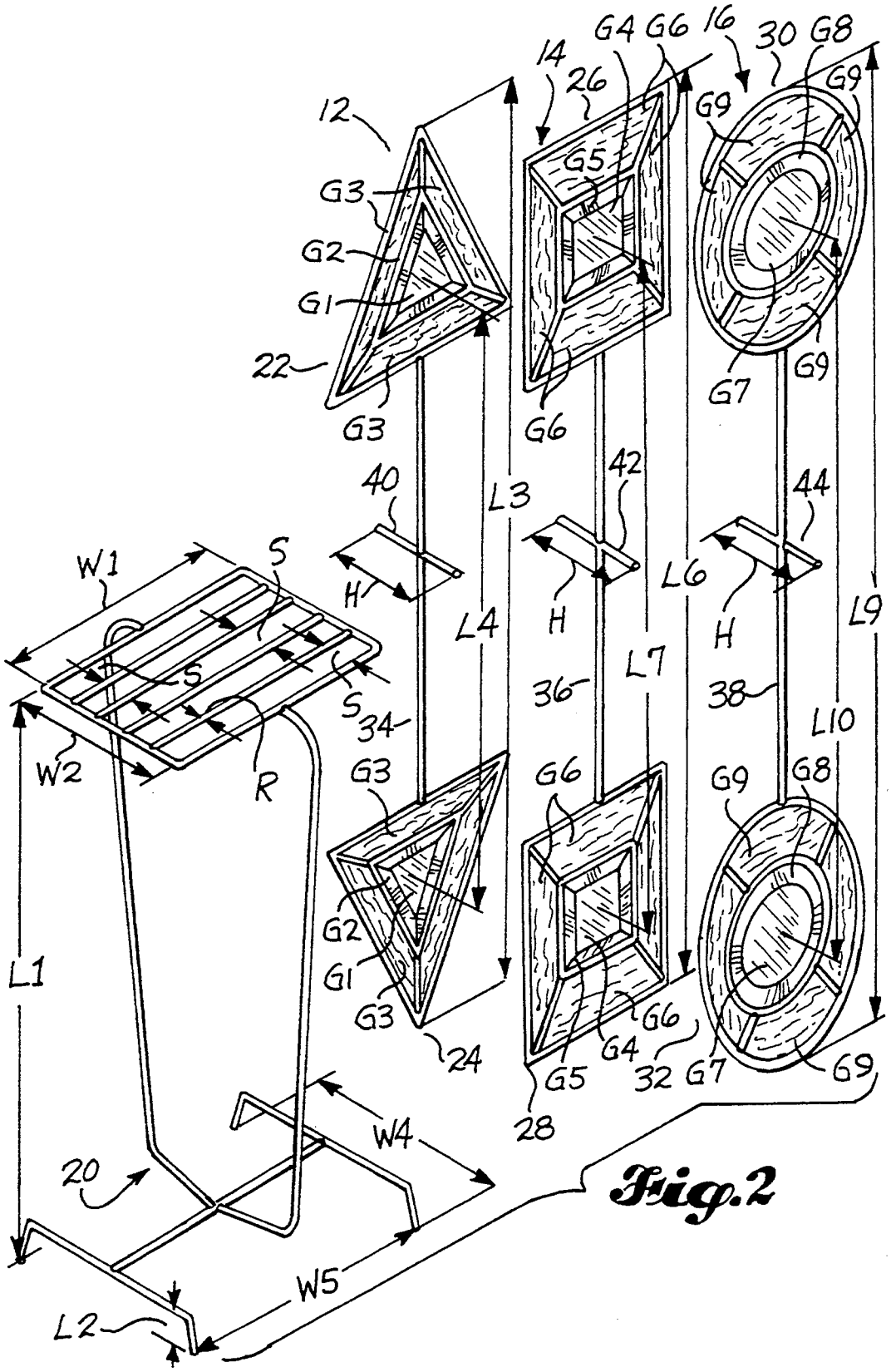
FIG. 2 is an exploded pictorial view of the embodiment of FIG. 1.

Referring first to FIG. 1 in the drawings, a first embodiment of the dynamic artwork 10, shown at rest, comprises a plurality of pendulums 12, 14, 16; a pendulum support 18; and a stand 20 which is configured to sit on a horizontal surface. FIG. 2 shows the dynamic artwork 10 of FIG. 1 with the pendulums 12, 14, 16 separated from the pendulum support 18 and the stand 20.

Each of pendulums 12, 14, 16 comprises two end members 22, 24, 26, 28, 30, 32 and an interconnecting central structure 34, 36, 38. The end members 22, 24, 26, 28, 30, 32 preferably include colored glass, clear glass, and beveled glass within a metal frame. Each interconnecting central structure 34, 36, 38 includes a central hub 40, 42, 44 and radial arm portions fixed at their inner ends to the hubs 40, 42 and at their outer ends to the end members 22, 24, 26, 28, 30, 32. Each hub 40, 42, 44 includes a pair of laterally outwardly projecting trunnions which provide low friction bearings for the hubs 40, 42, 44 on the pendulum support 18.

In the FIG. 2 embodiment, the pendulum support 18 and the stand 20 are constructed of a rigid material and have approximately the following dimensions: W1 is about six and one-half to eight and one-half inches; W2 is about four to six inches; W3 is about seven and one-half to nine and one-half inches; W4 is about five to seven inches; W5 is about seven to nine inches; L1 is about sixteen to eighteen inches; L2 is about three-fourths to one and one-fourth inches; S is about three-fourths to one and one-fourth inches; and R is about one-fourth to one-half inches. For pendulum 12, L3 is about twenty-eight and one-half to thirty and one-half inches, L4 is about nineteen to twenty-one inches, L5 is about nine and one-half to eleven and one-half inches, and H is about two to four inches. G1 is a clear glass with a clear beveled edge G2, and G3 is a blue stained glass. For pendulum 14, L6 is about twenty-seven and one-half to twenty-nine and one-half inches, L7 is about twenty and one-half to twenty-two and one-half inches, L8 is about eleven to thirteen inches, and H is about two to four inches. G4 is a clear glass with a clear beveled edge G5, and G6 is a red stained glass. For pendulum 16, L9 is about thirty and one-half to thirty-two and one-half inches, L10 is about twenty-two to twenty-four inches, L11 is about eleven to thirteen inches, and H is about two to four inches. G7 is a clear glass with a clear beveled edge G8, and G9 is a yellow stained glass. Each pendulum end member 22, 24, 26, 28, 30, 32 includes came members C of a suitable structural material.

Figure 3:
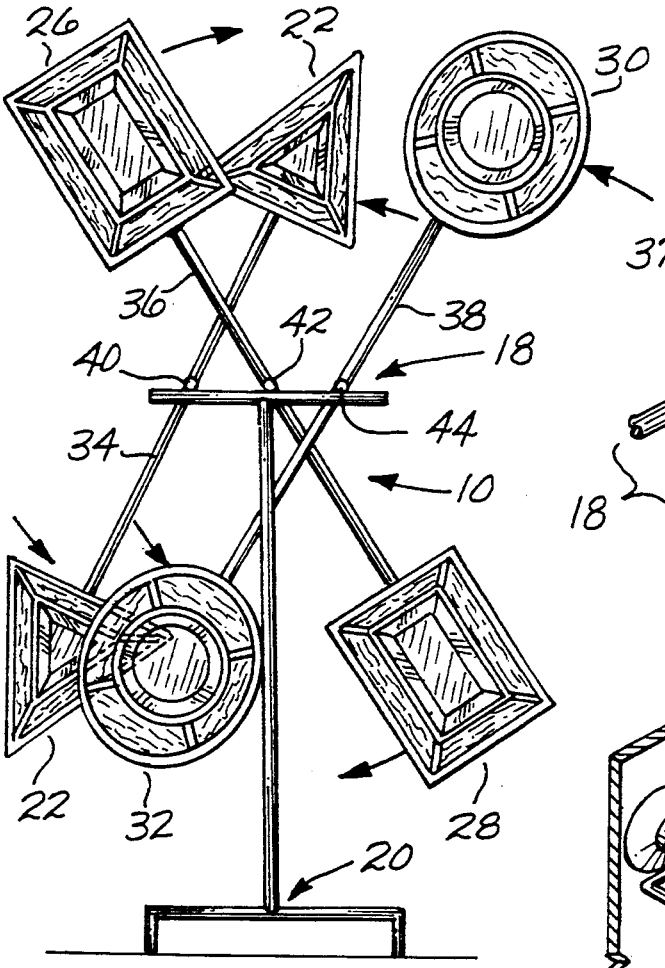
FIG. 3 is a front elevational view of the embodiment shown in FIG. 1, such view including arrows indicating motion of each pendulum.
Figure 4:
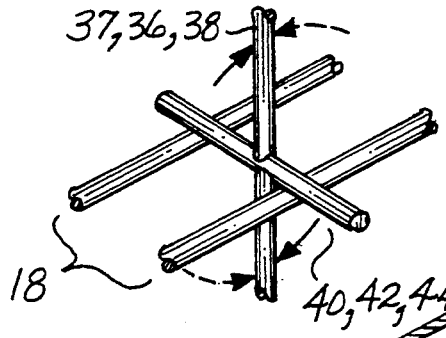
FIG. 4 is a detail view of the hub and the pendulum support.

In use, the pendulums 12, 14, 16 are mounted on the pendulum support 18 by inserting an end member 24, 28, 30 of each pendulum 12, 14, 16 into a slot S formed by and between pendulum support members 46, as shown in FIG. 1. Then, a starting force is applied to each pendulum 12, 14, 16, so as to swing each pendulum 12, 14, 16 from its equilibrium position. In response to the starting force, each pendulum 12, 14, 16 will pivot about the axis of its trunnions 40, 42, 44 and oscillate or swing about the axis, as illustrated in FIG. 3. During the oscillation, the end members 22, 24, 26, 28, 30, 32 will at times pass by each other, as illustrated in FIG. 3. At times two or more of the end members will be in alignment and different colors will be visible due to the passage of light through multiple layers of colored transparent or translucent portions of the end members 22, 24, 26, 28, 30, 32. The pendulums 12, 14, 16 may swing at differing rates with alignment occurring in a random manner, such that a viewer would observe many displays of various color, due to variations in alignment. Eventually the oscillation of the pendulums 14, 16 will damp out, each at its own rate, until the artwork 10 is at rest.

Figure 5:
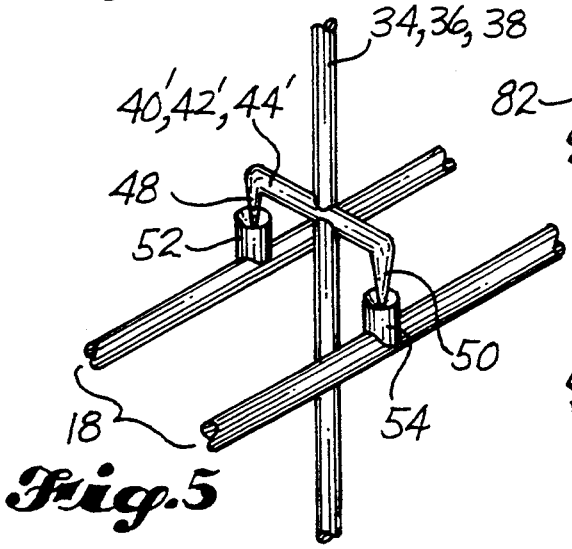
FIG. 5 is a detail view of another embodiment of the hub and pendulum support.

The central structure 34, 36, 38 of each pendulum 22, 24, 26 includes a hub 40, 42, 44. The central structure 34, 36, 38 may be made of any suitable rigid material (e.g. metal tubing, plastic, wood) which is capable of being securely affixed to each end member 22, 24, 26, 28, 30, 32 and the hub 40, 42, 44. The hub 40, 42, 44 is configured to have low frictional bearing on the pendulum support 18, so as to facilitate pivotal movement of the pendulums. The lower the friction of the hub 40, 42, 44 on the pendulum support 18, the larger number of oscillations the pendulums will make in response to a given starting force before being damped out. FIGS. 1–4 show one embodiment of the hub structure 40, 42, 44, wherein each hub structure 40, 42, 44 includes trunnions which rest upon the pendulum support 18 such that there is a low frictional bearing of the trunnions on the pendulum support 18 to allow for pivotal movement of the pendulums about the axis of the trunnion. FIG. 5 shows another embodiment of hub structure 40', 42', 44' wherein the hub structure 40', 42', 44' includes downwardly directed pivot points 48, 50 which rest upon raised portions 52, 54 of the pendulum support 18 and allow for low frictional support.

An artwork 10, constructed according to the present invention, may have two, three or more pendulums mounted on the pendulum support 18. Each pendulum may have one, two, three or more end members. FIG. 7 illustrates one embodiment of the pendulum which has three end members 56, 58, 60. The artwork 10 may comprise a plurality of pendulums having the same or differing numbers of end members. For example, a pendulum which has two end members may be mounted side by side on the pendulum support 18 with a pendulum having three end members.

The end members may be made of any suitable material such that they have sufficient mass to provide inertia power for a plurality of swings of the pendulum in response to a starting force applied to the pendulum. In one embodiment of the present invention, the end members 22 include decorative designs. The designs may be the same on each end member of a pendulum, or they may differ. FIGS. 1–3 illustrate an embodiment of the pendulums 12, 14, 16 in which each pendulum 12, 14, 16 has two end members. The end members 22, 24 of pendulum 12 are shaped substantially as triangles. The end members 26, 28 of pendulum 14 are substantially shaped as squares. The end members 30, 32 of pendulum 16 are substantially shaped as circles. The designs illustrated in FIGS. 1–3 and other simple designs may be entertaining and educational for children.

The end members may include a transparent or translucent material. The transparent material may be glass or plastic. The glass may be clear, colored, or shaped to refract light waves, such as textured or beveled glass. Interesting effects may be observed when translucent or transparent material is included in the end members. For example, primary colors, when overlapped or mixed, will produce secondary colors, etc. The material may be held together by foiling or a suitable came, according to techniques known in the art.

Plastic used in the end members may be clear, colored, and/or polarized. In one embodiment of the present invention, the end members comprise polarized plastic with designs created by the polarized plastic such that when a first end member is viewed alone, the plastic would appear to be clear, but when viewed with the polarized plastic of a second end member overlapping the first end member, a pattern would be visible. There is available a polarized tape which appears clear. This tape may be placed on a polarized or clear panel in different patterns. As the pendulums swing, the panels are swung relative to each other. As the tape regions move into alignment, colors are produced.

Figure 10:
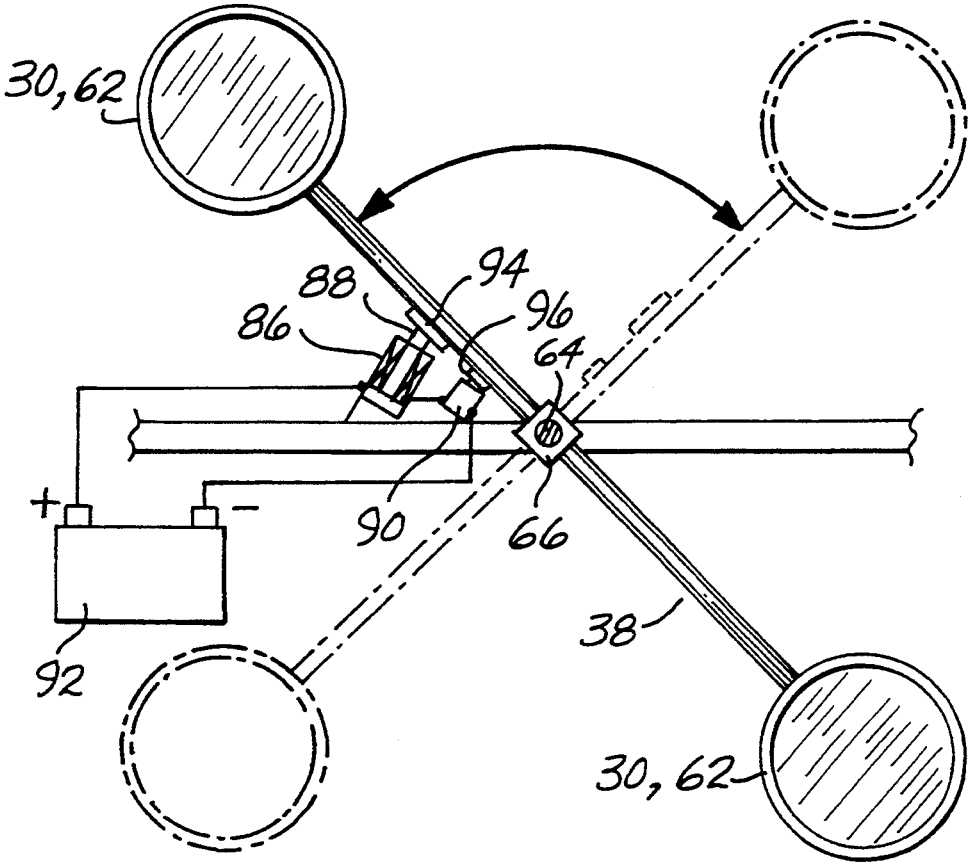
FIG. 10 is a view of an embodiment having a starting force mechanism.

FIG. 8 illustrates another embodiment of the artwork 10 of the present invention, wherein the pendulums 12', 14' 16' are mounted on a pendulum support 18' which is shaped as a single shaft 64 and the central structure of each pendulum includes a hub 66 which surrounds the shaft 64. The pendulums 12', 14', 16' are spaced from each other and from vertical members 68, by the use of spacers 70. FIG. 10 is an enlarged scale more detailed view of the hub 66. The hubs 66 include ball bearings 72 which surround the pendulum support 64 and allow for low frictional movement of the pendulums. The end members 74, 76 of each pendulum 12', 14', 16' may be connected to the hub 66 by affixing the end members 74, 76 within the sockets 78. In the FIG. 8 embodiment, the end members 62 are all round or oval, but could be square or triangular. The panes 80 are preferably plastic and may be colored or include polarized material, as described above.

The pendulum support 18 may be configured with various openings for receiving the hub of each pendulum. In a preferred embodiment of the present invention, the pendulum support 18 is configured with slots S for receiving the end members 22, 24, 26, 28, 30, 32 as shown in FIGS. 1–5. In this arrangement, the placement of the pendulums 12, 14, 16 on the pendulum support 18 may be varied by the user. The pendulum support 18 may be constructed of round rods 40, as shown in FIGS. 1–5. In another embodiment, the pendulum support 18 comprises raised portions 52, 54 which support the pivot points 48, 50 of the hub trunnions 40', 42', 44', as illustrated in FIG. 5. In another embodiment of the present invention, the pendulum support may comprise rods with flat upper surfaces.

The hub trunnions 40, 42, 44 of the pendulums are generally centrally located on the central structure 34, 36, 38, but preferably not at the exact center. In preferred form, each pendulum in an artwork 10 has the hub 40, 42, 44 placed on the central structure 34, 36, 38 at a location different from that of each other pendulum, such that pendulums swing in a randomized manner in response to a given starting force.

Figure 6:
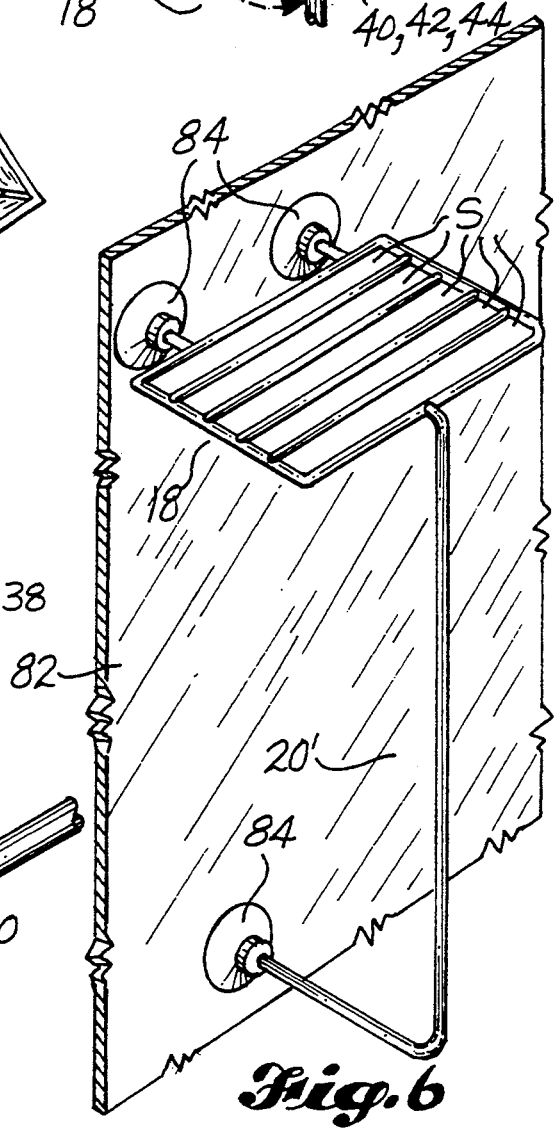
FIG. 6 is a pictorial view of an alternative embodiment of the pendulum support and stand.

The stand may be configured in various ways to support the pendulum support 18. The stand 20 may be rigidly affixed to the support 18, or it may be separate such that the pendulum support 18 may be affixed to various types of stands 20. The stand 20 may be configured to sit on a flat surface, as shown in FIGS. 1 and 2; or, the stand 20' may be constructed to be secured to a vertical surface, such as a plate glass window 82, such as by the use of suction cups 84, as shown in FIG. 6. Or, support 18 can be suspended from an elevated mounting such that the artwork 10 resembles a mobile.

The pendulums of the dynamic artwork 10 are set into motion by a starting force. In response to the starting force, the mass of the end members provides inertia power (accelerated by gravity) for a plurality of swings of the pendulum until the oscillations are damped out. In preferred form, the starting force is the user pivotably moving the pendulums 12, 14, 16 (or 12', 14', 16', etc.) from their equilibrium position. Also, in preferred form, the end member of each pendulum of an artwork 10 has differing masses such that the rate of swinging of each pendulum in response to a given starting force is varied.

Figure 11:
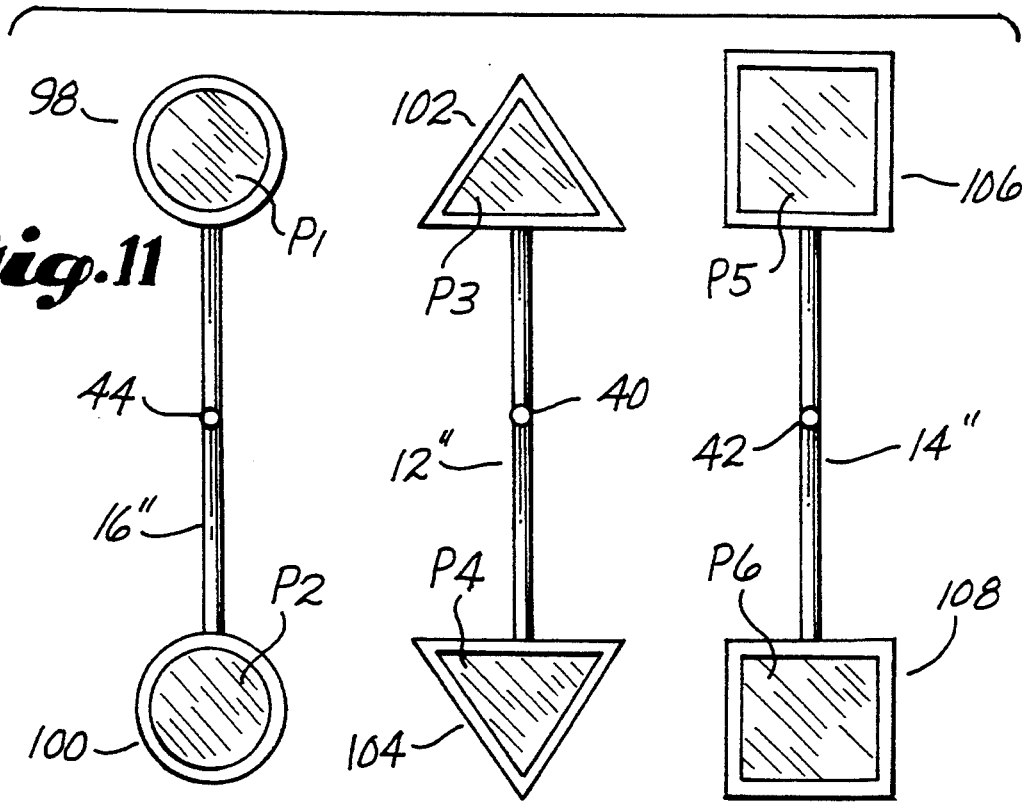
FIG. 11 is a side elevational view of additional embodiments of the pendulums.

Referring to FIG. 11, the frames of the end members 98, 100, 102, 104, 106, 108 are shown to be circular, triangular and square as in the first embodiment. In each frame there is a pane P1, P2, P3, P4, P5, P6 of transparent or translucent material. As described above, the pane material may be a pane of glass or plastic. It may be a pane of a polarized material. The panes P1, P2, P3, P4, P5, P6 for the different pendulums may be different colors. When polarized material is used, each pane may have the axis of polarization extending in a different direction. In fact, each pane may include a plurality of sections of polarized material, each having an axis extending in a different direction. A polarized film plastic tape is available from the Polaroid Corporation. This tape can be placed in different patterns on a pane, each with a different orientation of the axis of polarization. In such embodiment, when the pendulums swing relative to each other the light will be transmitted to each pane. When the panes are not in alignment, the light will appear in one way, or as a particular color. When the panes are in alignment with each other, so that an observer looks through the aligned panes, the polarized material will show a different color or colors. The modifications of this concept are endless.

The pane surrounding frame structure and the interconnecting straight portions of the pendulums may be made from wood, plastic or some other lightweight metal, e.g. thin wall metal tubing. If wood is used, it is desired that the wood be an attractive hardwood, such as oak, so that the beauty of the wood will add to the attractiveness of the artwork. In a preferred embodiment, the end members of one pendulum are round. The end members of a second pendulum are triangular. The end members of a third pendulum are square. This is shown in FIG. 11. The frame portions are constructed from oak and the members have a rounded cross section. The oak is stained and/or polished to bring out the grain and beauty of the wood. The panes are plastic and for each pendulum the panes have a different color or are a polarized material with a particular polarized axis which is different from the panes of the other pendulums.

The pendulums of the dynamic artwork 10 may also be set into motion by a power starting force as illustrated in FIG. 10. The starting force is provided by a circuit which includes a solenoid 86, a push rod 88, a proximity sensor 90, and a battery 92. The proximity sensor 90 is a form of a switch which is commonly known in the art and readily available. The push rod 88 of the solenoid 86 may be spring biased into a retracted position. The pendulum (e.g. 16) is equipped with a push pad 94 and a magnet 96. In use, as the pendulum 16 swings towards the solenoid 86, the proximity sensor 90 senses the magnet 96 and closes the circuit which includes battery 92 such that the solenoid 86 is activated. The solenoid 86 causes the push rod 88 to extend towards and against the push pad 94. The push rod 88 pushes the pendulum by impulse contact with the push pad 94. As the pendulum 12 is pushed, the magnet 96 moves away from the proximity sensor 90. The circuit is opened, the solenoid 86 is deactivated and the push rod 88 is spring retracted into a lowered position.

FIG. 12 shows a modified power drive for the pendulum. In this figure only one pendulum (e.g. 16') is shown. However, it is to be understood that a similar device may be used with the other pendulums of the assembly. Pendulum 16' includes a permanent magnet 110 at the bottom of its lower end portion 64. An electromagnet 112 is carried by base 114. Electromagnet 112 is directed upwardly. A proximity switch 116 is mounted on base 114 next to the electromagnet 112. When the electromagnet 112 is "ON", it emits a magnetic force with a polarity which is the same as the polarity of magnet 110. The magnets 110, 112 will thus oppose each other when magnet 110 swings into a position above electromagnet 112. Electromagnet 112 may be normally in an "OFF" position, with a proximity switch provided to turn it on only when end member 64 is adjacent the proximity switch 116. The proximity switch 116 would be activated by magnet 110. Or, the proximity switch can be eliminated and a manual switch provided to turn the electromagnet 112 "ON" and "OFF". When the electromagnet 112 is "ON", it will continuously produce an electromagnetic field which will cooperate with magnet 110 to provide the desired push on the pendulum 16'.

FIG. 13 shows an embodiment which is mounted on a window by suction cups 118. This embodiment has a continuous center shaft 64' (FIG. 14) on which the hubs 66 rotate. The hubs 66 may include roller bearings, ball bearings (see FIG. 9), bushings or the like. The bushings may be made from a self-lubricated plastic. The pendulums in this embodiment may be mounted for a full 360° swing. It may be desirable incorporate small electric drive motors in the hubs 66 for powering the pendulums through a full 360° swing.

A dynamic artwork constructed according to the present invention may be adapted to wind powered. Wind acting on the ends of the pendulums will tend to cause movement. The pendulum ends or the interconnecting arms of the pendulum may include blades or fins which catch the wind and facilitate movement by wind action.

It will be apparent to one skilled in the art that various changes and modifications can be made in the above device without departing from the true scope and spirit of the present invention. Because it is difficult to foresee further developments and/or improvements in the invention as described herein, it is to be understood that the preceding description is not to be taken in the limiting sense. Rather, the scope of the invention is defined by the following patent claims, the interpretation of which is to be made in accordance with the established doctrines of patent claim interpretation.

What is claimed is:

1. Dynamic artwork, comprising:

a pendulum support;

a plurality of pendulums positioned side-by-side on said pendulum support, each said pendulum comprising a plurality of spaced apart end members connected by an interconnecting central structure, said end members and said interconnecting central structure lying substantially within a single vertical plane, each central structure including a hub, each said hub mounted on said pendulum support such that each said pendulum has pivotal movement about a horizontal axis in response to a starting force, said pivotal movement of said pendulums moving each said end member back and forth within its vertical plane, along an arcuate path, each said end member of each said pendulum traveling an arcuate path which from a viewer's vantage perpendicular to the vertical planes, overlaps the arcuate path of another end member on another said pendulum; and each said end member of each said pendulum having sufficient mass to provide inertia power for a plurality of swings of the pendulum in response to a starting force applied to the pendulum, with each said pendulum swinging back and forth about its horizontal axis causing each said end member to move back and forth along its said arcuate path, within a vertical plane, adjacent each other said pendulum, with each said end member of each said pendulum aligning with another said end member of another pendulum in a random pattern.

2. The dynamic artwork of claim 1, wherein the pendulum support is connected to a stand.

3. The dynamic artwork of claim 1, further comprising a stand connected to the pendulum support, wherein the stand includes fastening displays for securing the stand to a vertical surface.

4. The dynamic artwork of claim 3, wherein the fastening displays include suction cups.

5. The dynamic artwork of claim 1, wherein the pendulum support further includes openings and wherein each said opening receives an interconnecting central structure of a pendulum.

6. The dynamic artwork of claim 5, wherein each hub of each said pendulum further includes a trunnion and each trunnion of each pendulum straddles an opening to position said pendulum on said pendulum support.

7. The dynamic artwork of claim 1, wherein there are three pendulums.

8. The dynamic artwork of claim 1, wherein at least one of said pendulums has two end members.

9. The dynamic artwork of claim 1, wherein at least one of said pendulum has three end members.

10. The dynamic artwork of claim 1, wherein each said hub comprises a trunnion.

11. The dynamic artwork of claim 1, wherein each said hub comprises a pivot point.

12. The dynamic artwork of claim 1, further including a push pin which is activated by a solenoid for providing the starting force.

13. The dynamic artwork of claim 1, wherein each of said hubs includes ball bearings.

14. Dynamic artwork, comprising:

a pendulum support;

a plurality of pendulums positioned side-by-side on said pendulum support, each said pendulum comprising a plurality of spaced apart end members connected by an interconnecting central structure, each central structure including a hub, each of the end members comprising a translucent material, each said hub mounted on said pendulum support such that each said pendulum has pivotal movement about a horizontal axis in response to a starting force; and each said end member of each said pendulum having sufficient mass to provide inertia power for a plurality of swings of the pendulum in response to a starting force applied to the pendulum, with each said pendulum swinging back and forth about its horizontal axis, within a vertical plane, adjacent each other said pendulum.

15. The dynamic artwork of claim 14, wherein the translucent material includes primary colors such that when the end members overlap, secondary colors are visible.

16. Dynamic artwork, comprising:

a pendulum support;

a plurality of pendulums positioned side-by-side on said pendulum support, each said pendulum comprising a plurality of spaced apart end members connected by an interconnecting central structure, each central structure including a hub, at least one of said pendulums having three end members, a first of said pendulums having end members which are substantially round in shape, a second of said pendulums having, end members which are substantially rectangular in shape and a third of said pendulums having end members which are substantially triangular in shape, each said hub mounted on said pendulum support such that each said pendulum has pivotal movement about a horizontal axis in response to a starting force; and each said end member of each said pendulum having sufficient mass to provide inertia power for a plurality of swings of the pendulum in response to a starting force applied to the pendulum, with each said pendulum swinging back and forth about is horizontal axis, within a vertical plane, adjacent each other said pendulum.

* * * * *